US006174202B1

(12) United States Patent
Mitra

(10) Patent No.: US 6,174,202 B1
(45) Date of Patent: Jan. 16, 2001

(54) SHIELDED CONNECTOR HAVING MODULAR CONSTRUCTION

(75) Inventor: Niranjan Mitra, Eindhoven (NL)

(73) Assignee: BERG Technology, Inc., Reno, NV (US)

( * ) Notice: Under 35 U.S.C. 154(b), the term of this patent shall be extended for 0 days.

(21) Appl. No.: 09/227,638

(22) Filed: Jan. 8, 1999

(51) Int. Cl.[7] ..... H01R 13/648
(52) U.S. Cl. ..... 439/608
(58) Field of Search ..... 439/607, 608, 439/609, 610, 701

(56) References Cited

U.S. PATENT DOCUMENTS

| | | | |
|---|---|---|---|
| 4,460,226 | 7/1984 | Hageman | 339/55 |
| 4,571,014 | 2/1986 | Robin et al. | 339/14 R |
| 4,603,889 | 8/1986 | Welsh | 285/175 |
| 4,632,476 | 12/1986 | Schell | 339/14 R |
| 4,846,727 | 7/1989 | Glover et al. | 439/608 |
| 4,898,546 | 2/1990 | Elco et al. | 439/608 |
| 5,104,341 | 4/1992 | Gilissen et al. | 439/608 |
| 5,169,343 | 12/1992 | Andrews | 439/608 |
| 5,174,770 | 12/1992 | Sasaki et al. | 439/108 |
| 5,199,886 | 4/1993 | Patterson | 439/79 |
| 5,261,829 | 11/1993 | Fusselman et al. | 439/108 |
| 5,286,212 | 2/1994 | Broeksteeg | 439/108 |
| 5,310,354 * | 5/1994 | Oswald, Jr. | 439/608 |
| 5,507,655 | 4/1996 | Goerlich | 439/108 |
| 5,620,340 | 4/1997 | Andrews | 439/608 |

FOREIGN PATENT DOCUMENTS 0 638 967 A2 7/1994 (EP) .

* cited by examiner

*Primary Examiner*—Neil Abrams
*Assistant Examiner*—Javaid Nasri
(74) *Attorney, Agent, or Firm*—Woodcock Washburn Kurtz Mackiewicz & Morris LLP

(57) ABSTRACT

Methods and apparatus are disclosed for manufacturing and for providing electrical connectors having maximum shielding from electronic interference. Maximum shielding is inexpensively achieved by manufacturing a shield structure from a single piece of material in a manner yielding individual channels for shielding a contact terminal from the receptacle area to the tail area. Contact terminals are integrated into the shield structure via insertion molding to form a column connector module. A plurality of column connector modules are then inserted into an appropriately formed front housing. As described by the method of this invention, shielding from electronic interference occurs not only between adjacent terminals within a column structure, but also, between terminals contained in adjacent column connector modules.

7 Claims, 9 Drawing Sheets

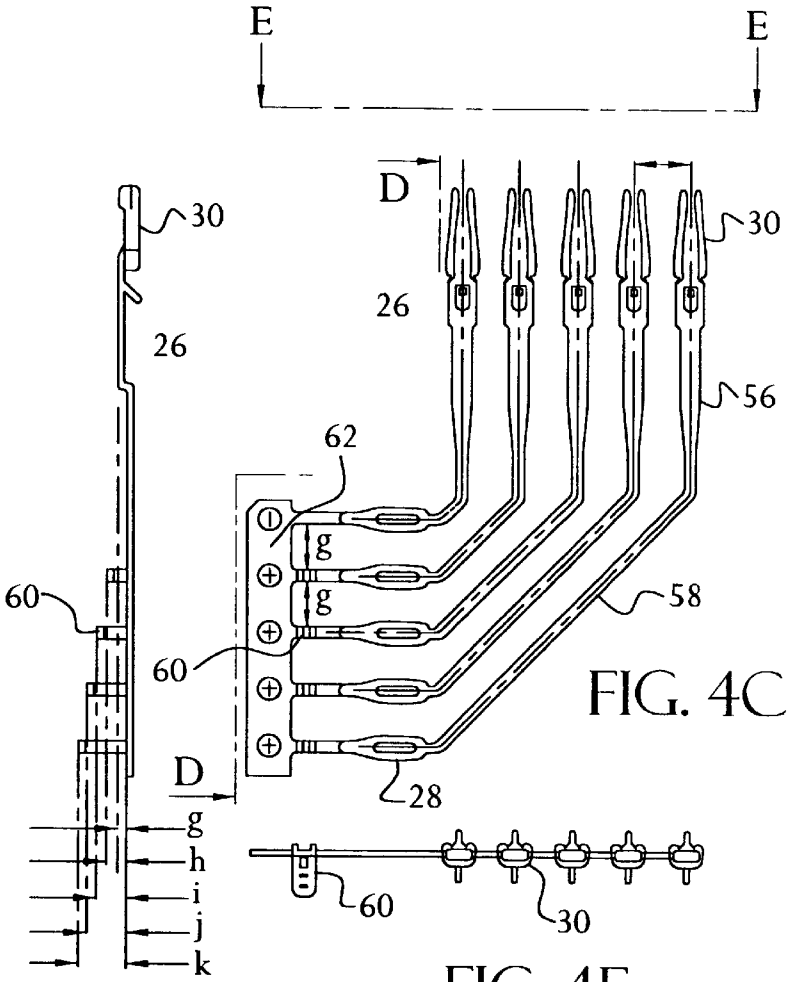
FIG. 4C
FIG. 4E
FIG. 4D
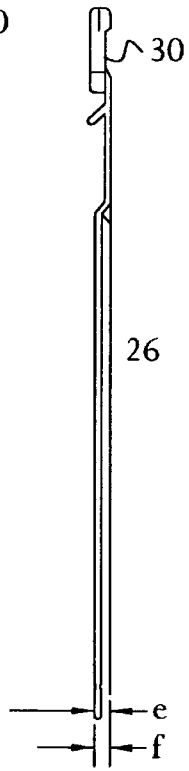
FIG. 4B
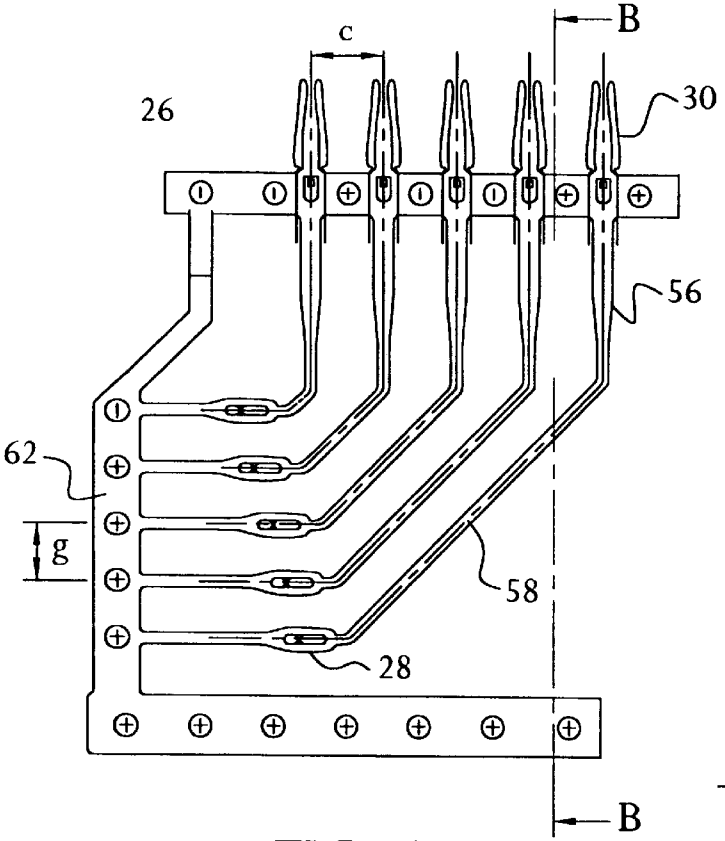
FIG. 4A

SHIELDED CONNECTOR HAVING MODULAR CONSTRUCTION

RELATED APPLICATIONS

The present invention is related by subject matter to the inventions disclosed in commonly assigned application having Ser. No. 09/227,907, filed concurrently herewith on Jan. 8, 1999, entitled "Connector with Improved Shielding and Insulation".

FIELD OF THE INVENTION

The present invention relates to electrical connectors and more particularly to shielded connectors and to a method of making connectors such that the connectors provide optimum shielding from electronic interference.

BACKGROUND OF THE INVENTION

The transition from analog electronics to digital electronics has caused sweeping technological changes within telecommunications and electronic instrumentation industries. For example, as clock-speeds in digital circuitry increase, so do the challenges in maintaining signal integrity with respect to adjacent signals interfering with one another. Other driving forces, that have also created technical challenges, are the demand for miniaturization of electronic devices and the demand for increasing the number of discrete functions associated with each electronic device. The latter two driving forces results in the packing of multiple electronic functions within a smaller cabinet volume, i.e., within a smaller surface space on a printed circuit board (PCB) within the cabinet dimensions. The limited PCB surface space requires closer component spacing that can result in components electrically interfering with or being influenced by neighboring components. For example, the phenomenon of antenna and receiver (crosstalk) is well known in the art.

More specifically, older connector designs were based on the use of low frequency signals using relatively high voltage and steady state current levels in which the flow of the energy was evenly distributed over the total cross-section of a conductor. A result of the effective impedance to the flow of such energy was electrical resistance. By contrast, contemporary digital signals operate at much higher frequencies with signal amplitudes in the micro-volt level. With such high frequency signals, transmission of energy migrates to the outer "skin" of the conductor and can be transmitted. Consequently, the impedance of the interconnect becomes an important design parameter.

In recent years, equipment designers and users have become more sensitive to the problems raised by increases in clock speed (frequency) and miniaturization. To alleviate these problems, there has been a gradual design shift towards coaxial or pseudo-coaxial shielded components.

New connector designs provide shielded interconnects with characteristics that allow propagation of high speed signals while reducing cross talk. In such interconnects, the electronic signal element, i.e., the connector terminal path, is preferably enclosed by an equi-spaced air annulus bounded by a metal shield, air being a preferred dielectric.

Optimum coaxial performance is achieved by a cylindrically shaped connector having a minimum of cross-section change over the length of the interconnect. In such a connector, the distance between the center conductor and the shield preferably will be uniform over the length of the connector. Unfortunately, round, coaxial connectors are typically machine-turned and expensive to manufacture.

Other types of shielded connectors, are substantially rectangular in shape, as a result of stamping. Connectors assembled with stamped components are easier and more cost-effective to manufacture. Generally such stamped structures typically include rectangular-shaped internal contact terminals.

Shielding such rectangular components requires an equi-spaced dielectric annulus. By the very fact that the shield structure is rectangular, rather than circular, there is a natural deviation with respect to ideal coaxial shielding. The performance of such shielding is less optimal than that of the ideal coaxial shielding and is, therefore, referred to as pseudo-coaxial.

Right angle or horizontal connectors are commonly used for many backplane applications. Not uncommonly, such right angle connectors, are designed to be press-fit to a printed circuit board and contain multiple rows and columns. In manufacturing such connectors, the contact terminals are stitched into a housing after which the back end of the terminal, known as the tail, is bent. Such bending is usually done row by row. The disparity in tail length between each row causes a difference in the impedance path for adjacent terminals. The resultant cross-talk from the tail section of such a connector is approximately 30 to 35% of the total crosstalk for the mated connector. A significant part of the cross-talk is attributed to the close spacing of the contact terminals.

Hence, there still exists a need to design a right-angle connecter having reduced size without sacrificing shielding performance for high frequency signals.

SUMMARY OF THE INVENTION

The above described problems are resolved and other advantages are achieved in a shielded electrical connector constructed by forming a shield from sheet material, fixing stamped terminals to the shield such that the terminals are positioned equal annular distances from the shield, whereby the terminals and the connector shield define a column connector module, and by inserting a plurality of the shielded connector modules into an appropriately formed housing.

According to one aspect of the invention, the step of forming a shield is performed by first forming the sheet material into a planar portion and a leg portion wherein the leg portion is defined by a plurality of legs having a first position lying in the same plane as the planar portion and that extend from the planar portion. Next the legs are bent so that they are perpendicular to the first position thereby defining a second position. Then, the legs are bent again from the second position over and onto the planar portion thereby defining a third position, forming a plurality of channels having a receptacle receiving portion and a tail receiving portion.

In preferred embodiments of the invention, the sheet material is metal and the plurality of legs are secured to the planar portion of the stamped piece of sheet material.

In yet another embodiment of the invention, the plurality of legs have a plurality of protrusions and the planar portion of the stamped piece of sheet material has a plurality of apertures designed to cooperate with and matingly receive the plurality of protrusions. In such an embodiment, the step of bending the legs includes bending the legs so that they are perpendicular to the first position of the leg portion defining a second position and bending the legs from the second position over and onto the planar portion defining a third position whereby the apertures in the planar portion of the stamped flat piece of sheet material matingly receive the protrusions thereby forming a plurality of channels.

According to another aspect of the invention a terminal is provided within each channel, wherein each terminal is formed to receive a mating pin and wherein each terminal defines a tail portion that protrudes beyond the angular tail section. In such an embodiment, the terminals and channels are fixed to one another by an insert-molding process. In such an embodiment it is preferred to insert-mold in only the tail receiving portion. It is especially preferred for the insert-molding material to be a dielectric material.

In yet another embodiment of the invention, a lobe is formed on the planar portion of the sheet material, preferably by pressing the sheet material.

DETAILED DESCRIPTION OF THE DRAWINGS

The present invention will be better understood and its numerous objects and advantages will become apparent by reference to the following detailed description of the invention when taken in conjunction with the following drawings, in which.

Figures 3A, 3B, 3C, 3D, 3E:
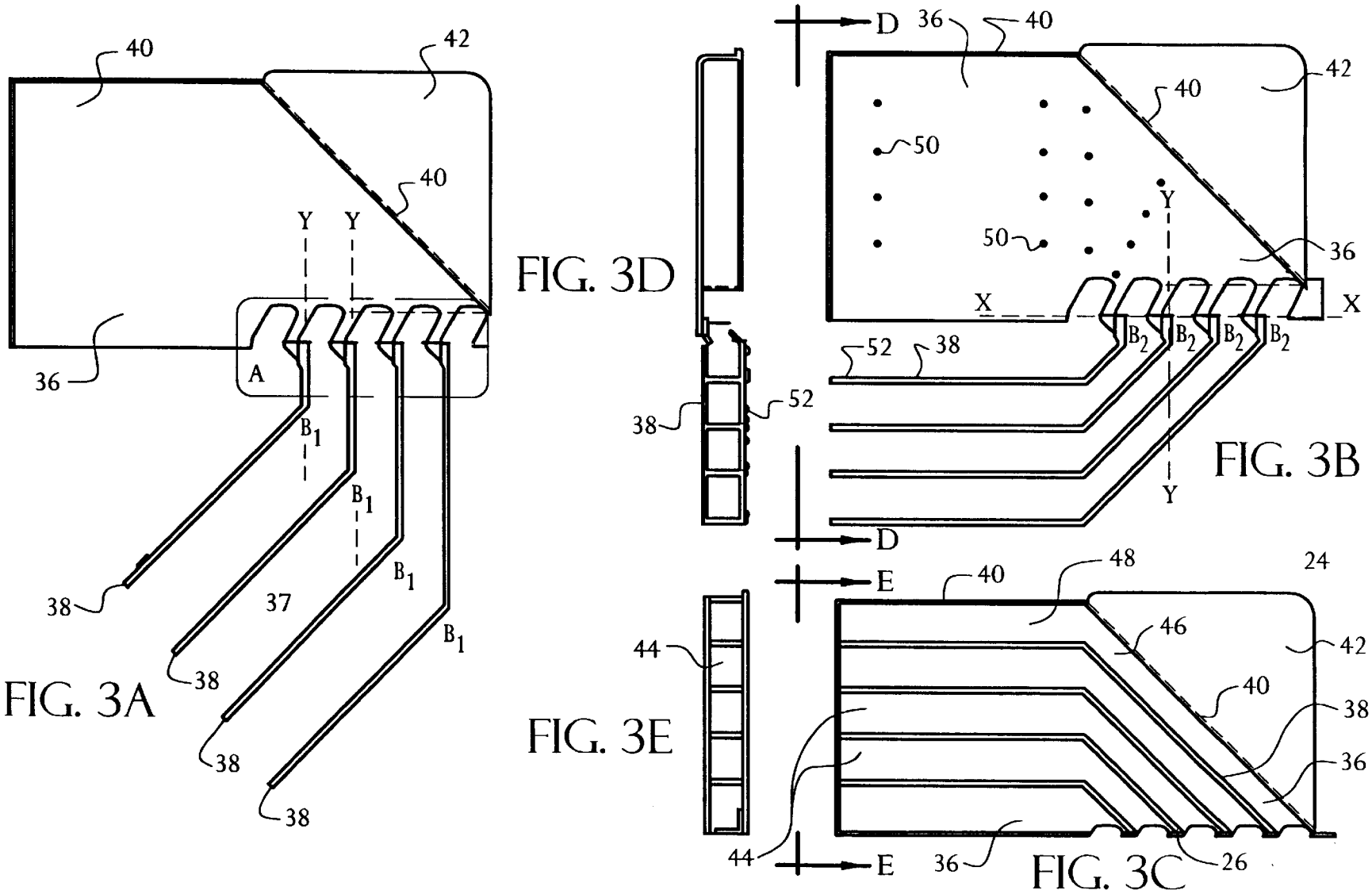
Figure 5A:
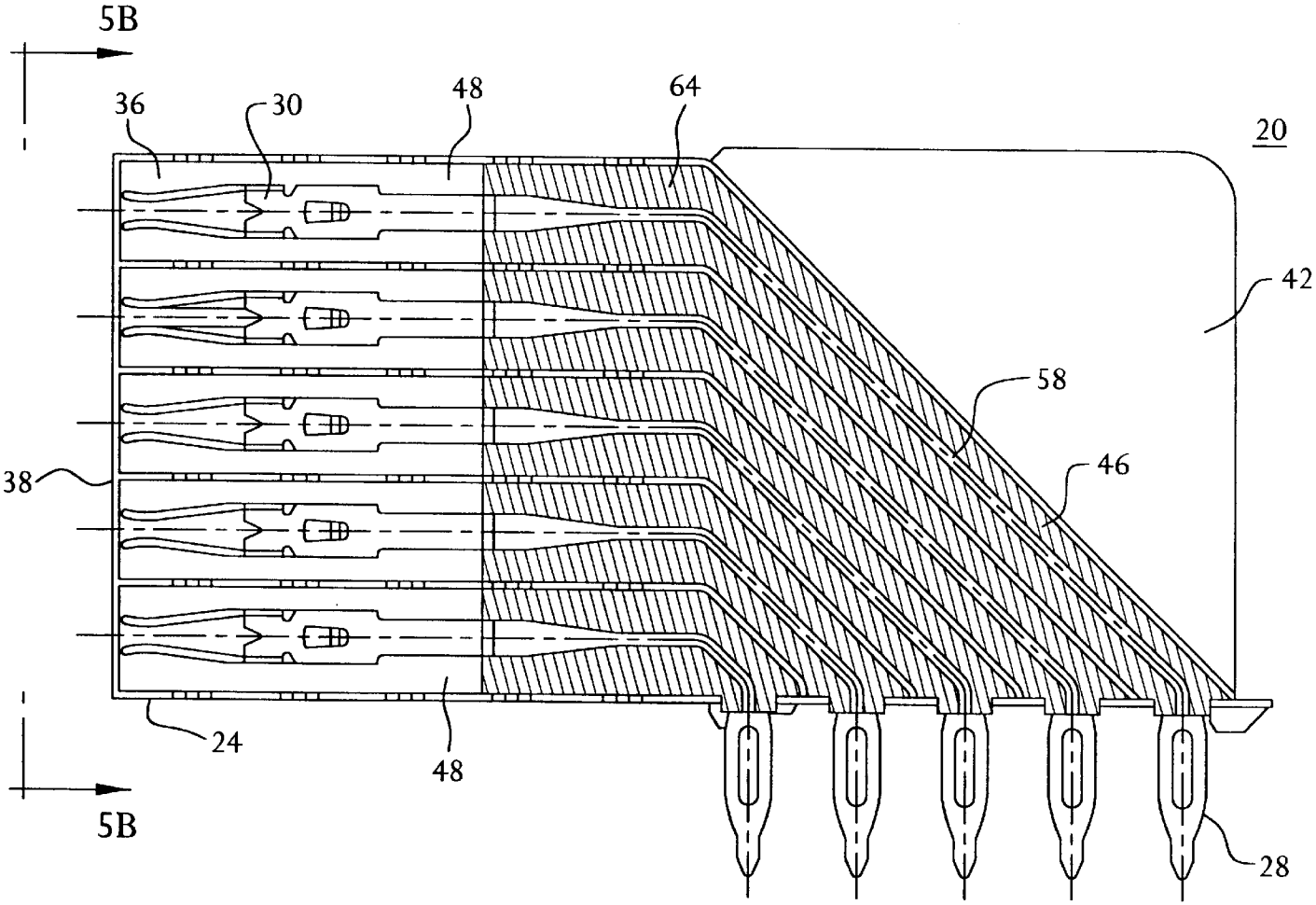
Figure 5B:
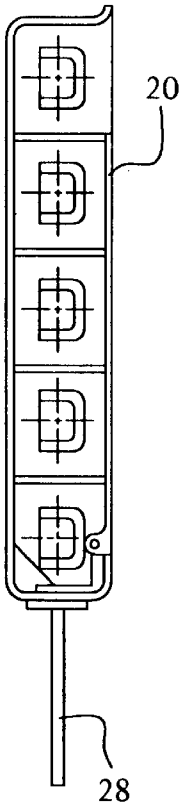
Figure 6:
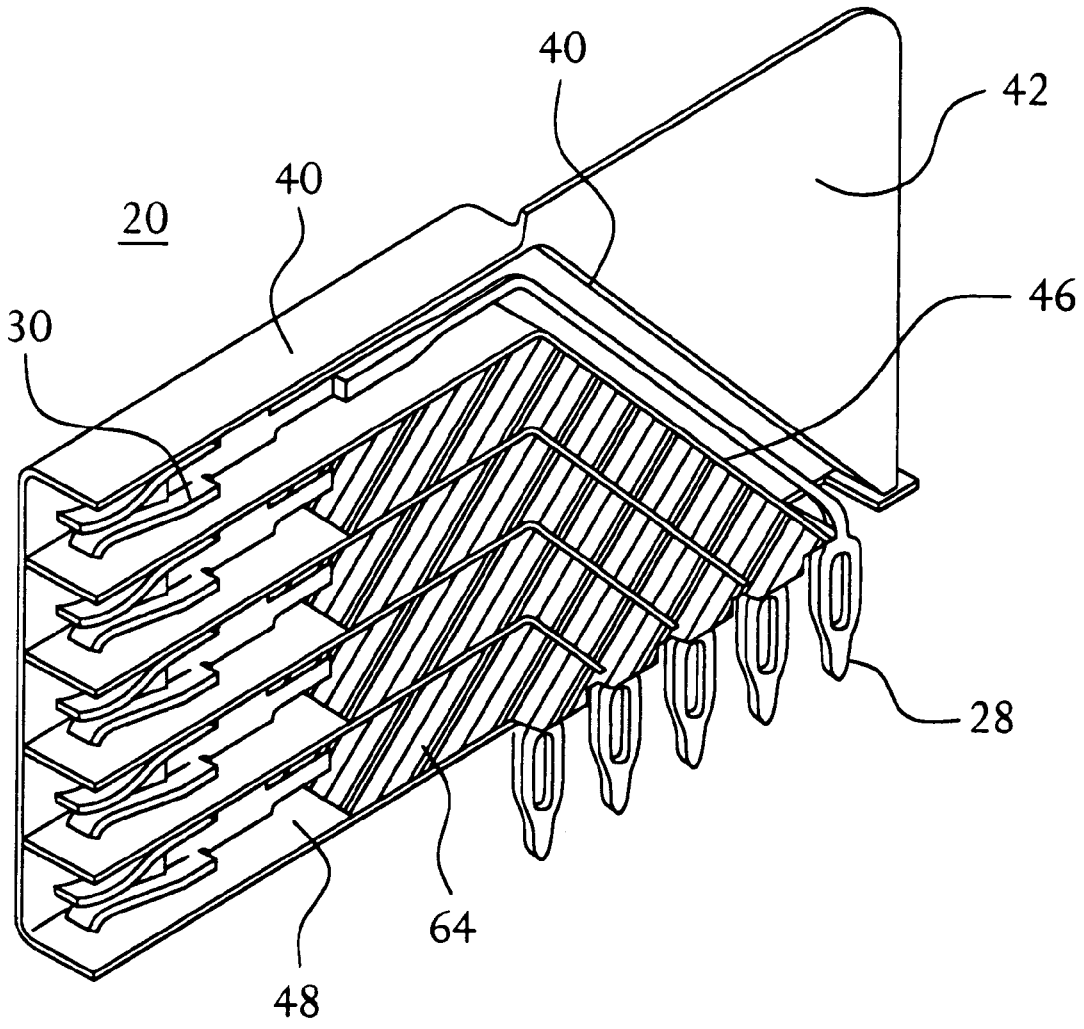
Figure 7:
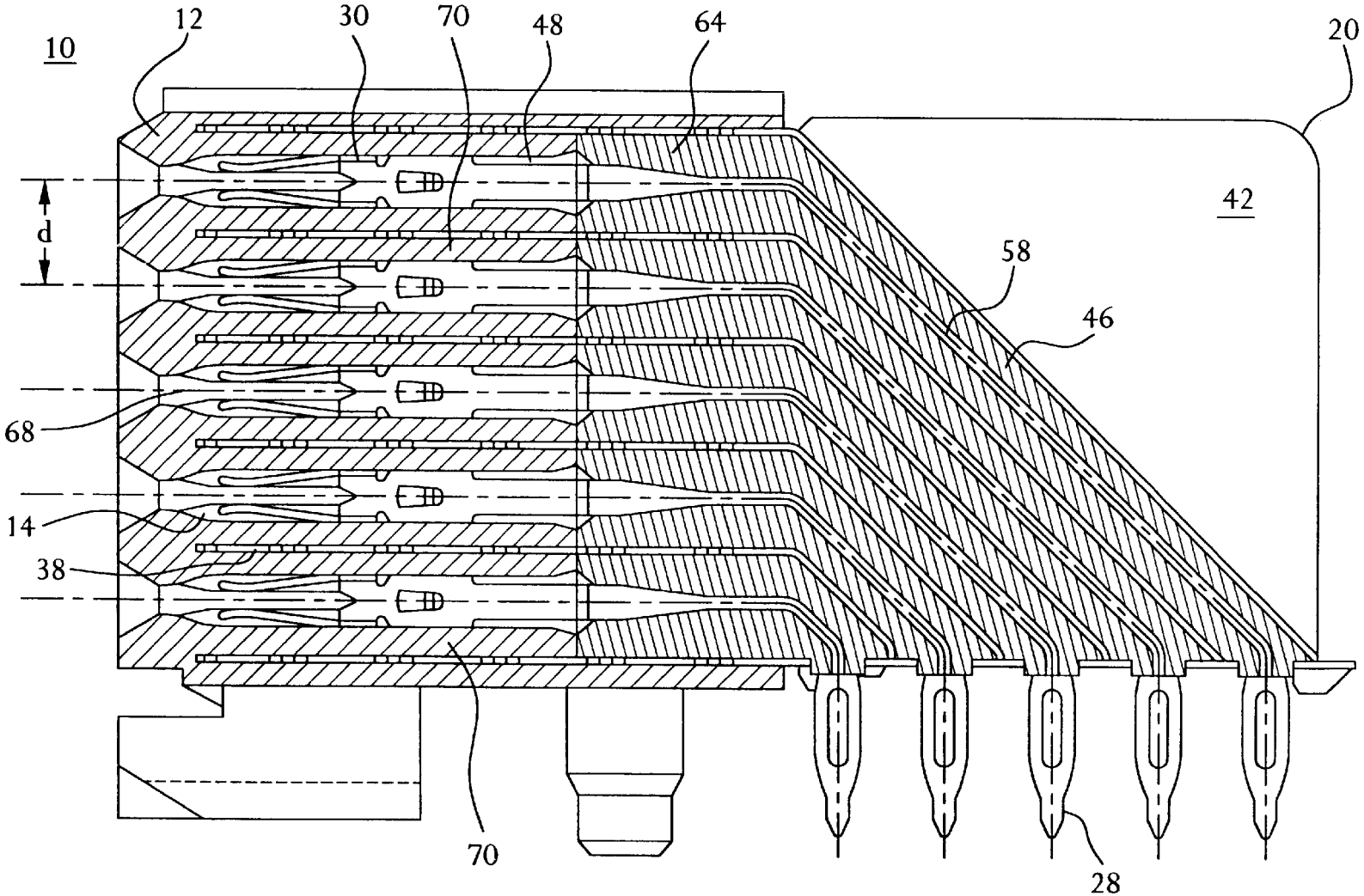
Figure 8:
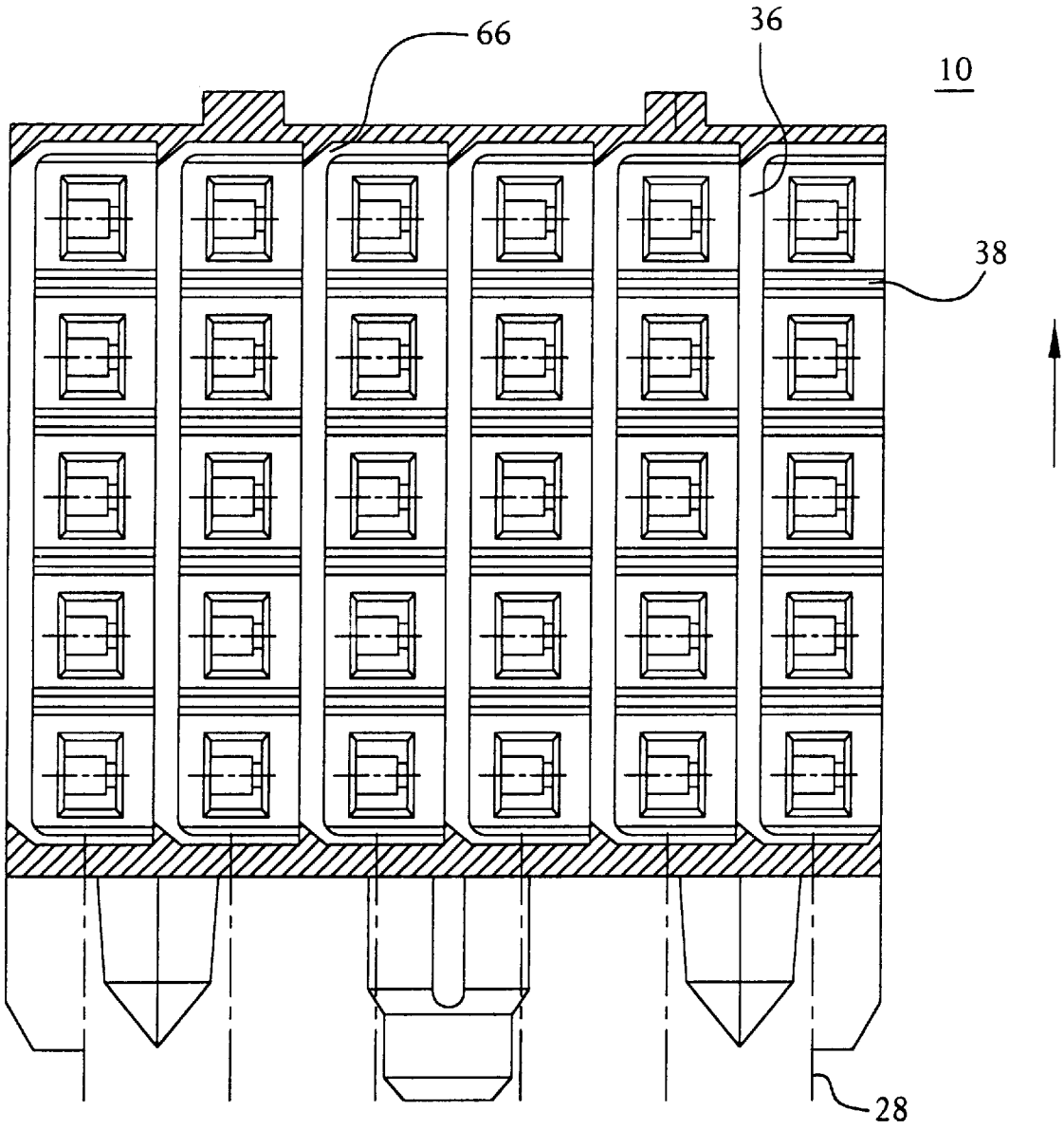

FIGS. 3A–C show a connector housing made according to the method of the invention;

FIG. 4A is a top planar view of a stamped and formed terminal for a five row module showing it's original pitch and still mounted on a carrier frame;

FIG. 4B is a cross sectional view of the terminal of FIG. 4A taken through line A—A of FIG. 4A;

FIG. 4C is a top planar view of the cut out terminal of FIG. 4A after the pitch has been translated;

FIG. 4D is a cross sectional view of the terminals of FIG. 4C taken through line B—B of FIG. 4C;

FIG. 4E is a side planar view of the terminals of FIG. 4C;

FIG. 5A is a top planar view of the conductor housing fitted with terminals, defining a connector column;

FIG. 5B is a vertical frontal view of the connector column of FIG. 5A;

FIG. 6 is a three-dimensional view of a connector column described in FIGS. 5A–B;

FIG. 7 is a cross-sectional view of an electrical connector showing the connector column of FIG. 6A inserted into a front housing; and FIG. 8 is a rear view of the electrical connector of FIG. 7 showing a plurality of connector columns inserted into the front housing that comprises the electrical connector.

DETAILED DESCRIPTION OF PREFERRED EMBODIMENTS

A right-angled shielded connector and method of making the same, according to the present invention, will now be described with reference to the Figures. It will be appreciated that the description given herein with respect to the Figures is for exemplary purposes only and is not intended in any way to limit the scope of the invention. For example, the Figures describe a right-angled shielded connector and a method for making the same. However, the concepts disclosed herein have a much broader application to a much wider variety of connectors. The concepts disclosed with reference to this connector could also be employed, for example, with a straight connector.

Figure 1:
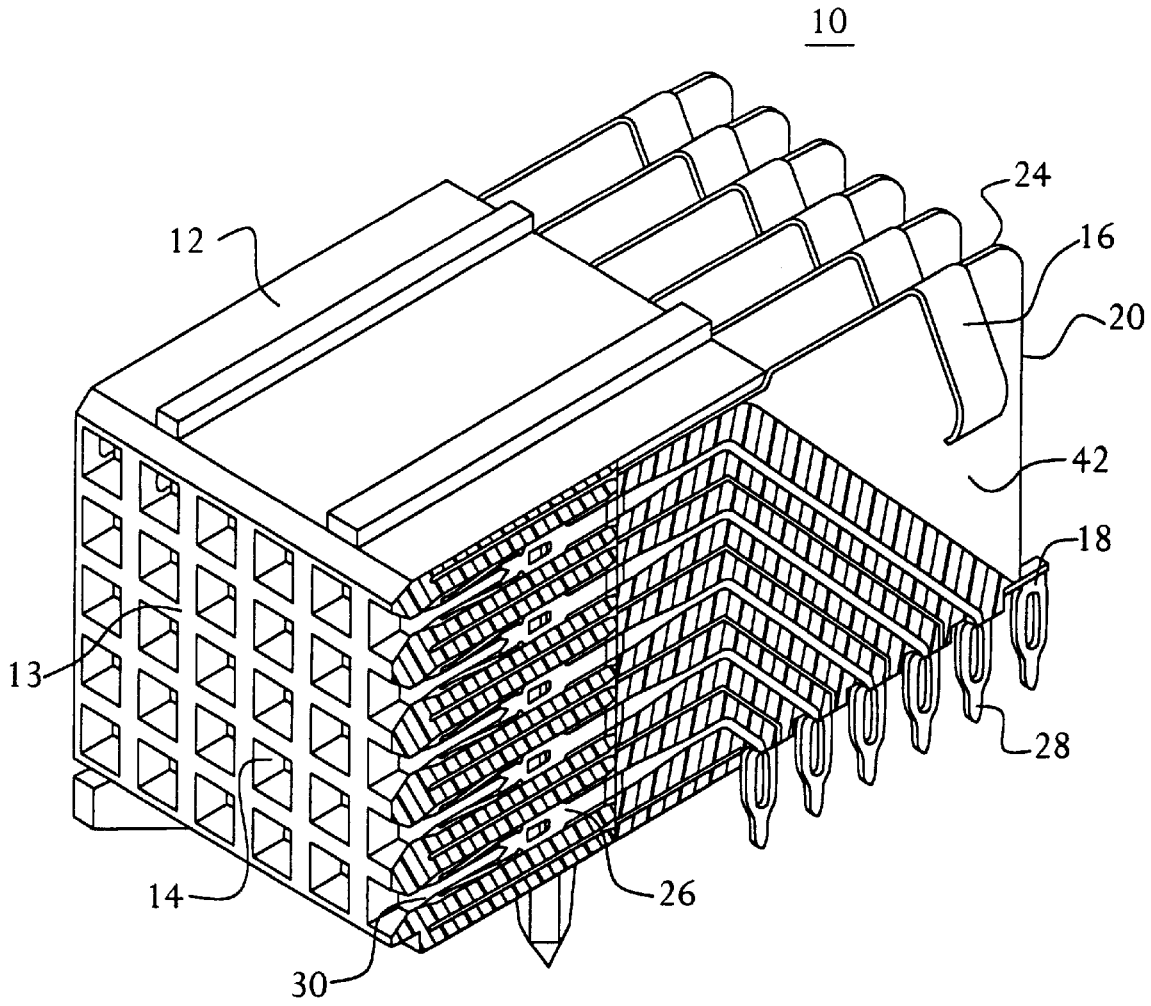
FIG. 1 is a perspective, partial section view of an electrical connector according to the invention.

FIG. 1 shows a connector 10 constructed in accordance with the invention. Connector 10 comprises a front housing 12, wherein front housing 12 includes a front face 13 having a plurality of receptacle openings 14, and a plurality of connector columns 20 (only one is shown). Each connector column 20 includes a conductor shield 24 and terminals 26 for conducting electrical signals. Each conductor shield 24 includes a side spring 16 and an optional press-fit ground pin 18. Each terminal 26 also includes a press fit tail 28 and a receptacle portion 30. The plurality of the receptacle portions in the final assembled connector 10 are arranged in rows (horizontally) and in columns (vertically) to correspond to openings 14.

Figure 1A:
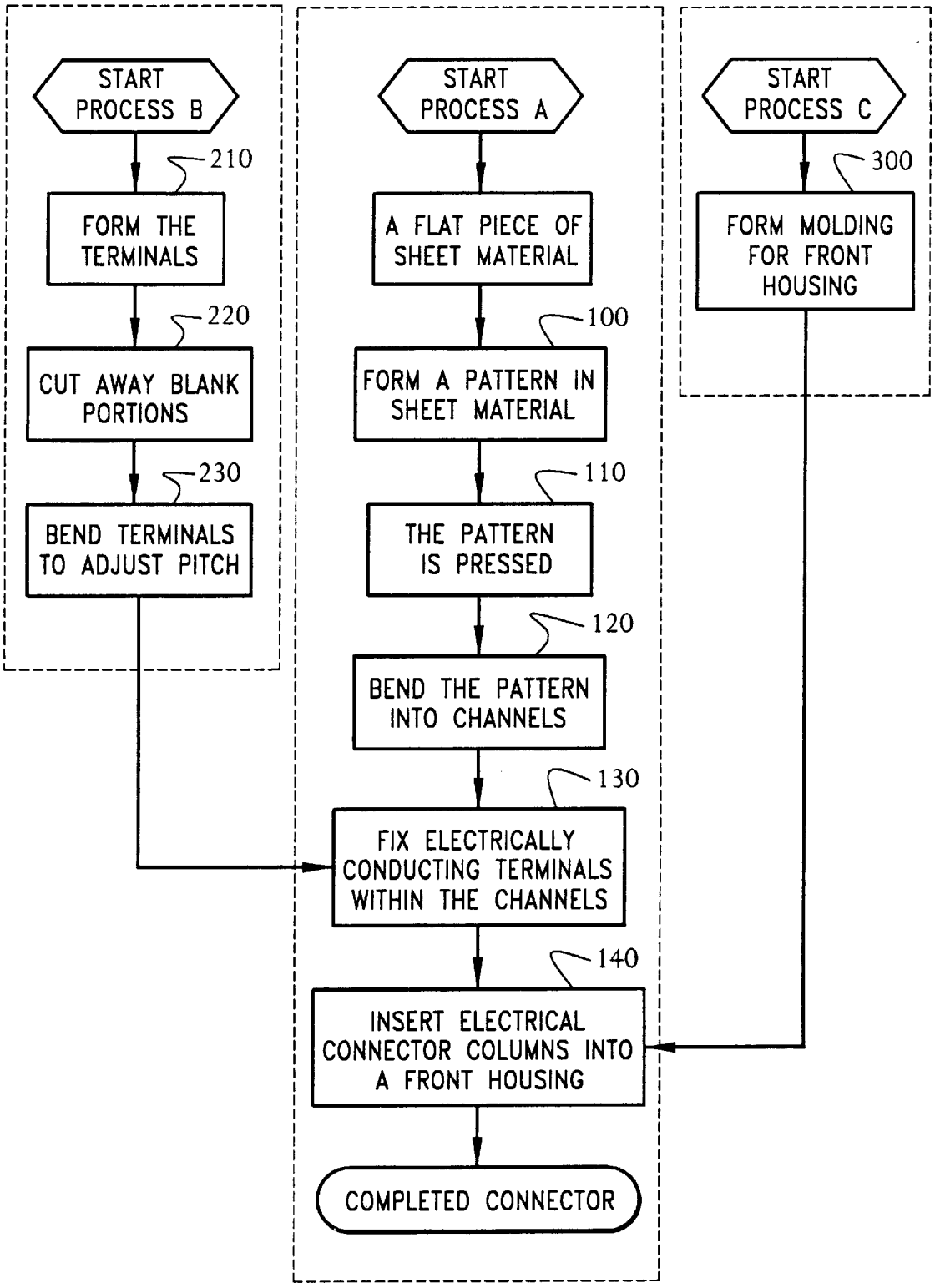
FIG. 1A is a flow chart of the processes by which the electrical connector of FIG. 1 is made.

FIG. 1A is a flow chart of the processes for making connector 10 of FIG. 1. Processes A, B, and C are performed independently from each other, however, the products of processes B and C are required in process A as indicated by the dotted lines. In describing the processes for manufacturing connector 10, reference will also be made to FIGS. 2 through 5, wherein there is shown a series of top, plan and perspective views of connector 10 during various stages of manufacture.

Figure 2:
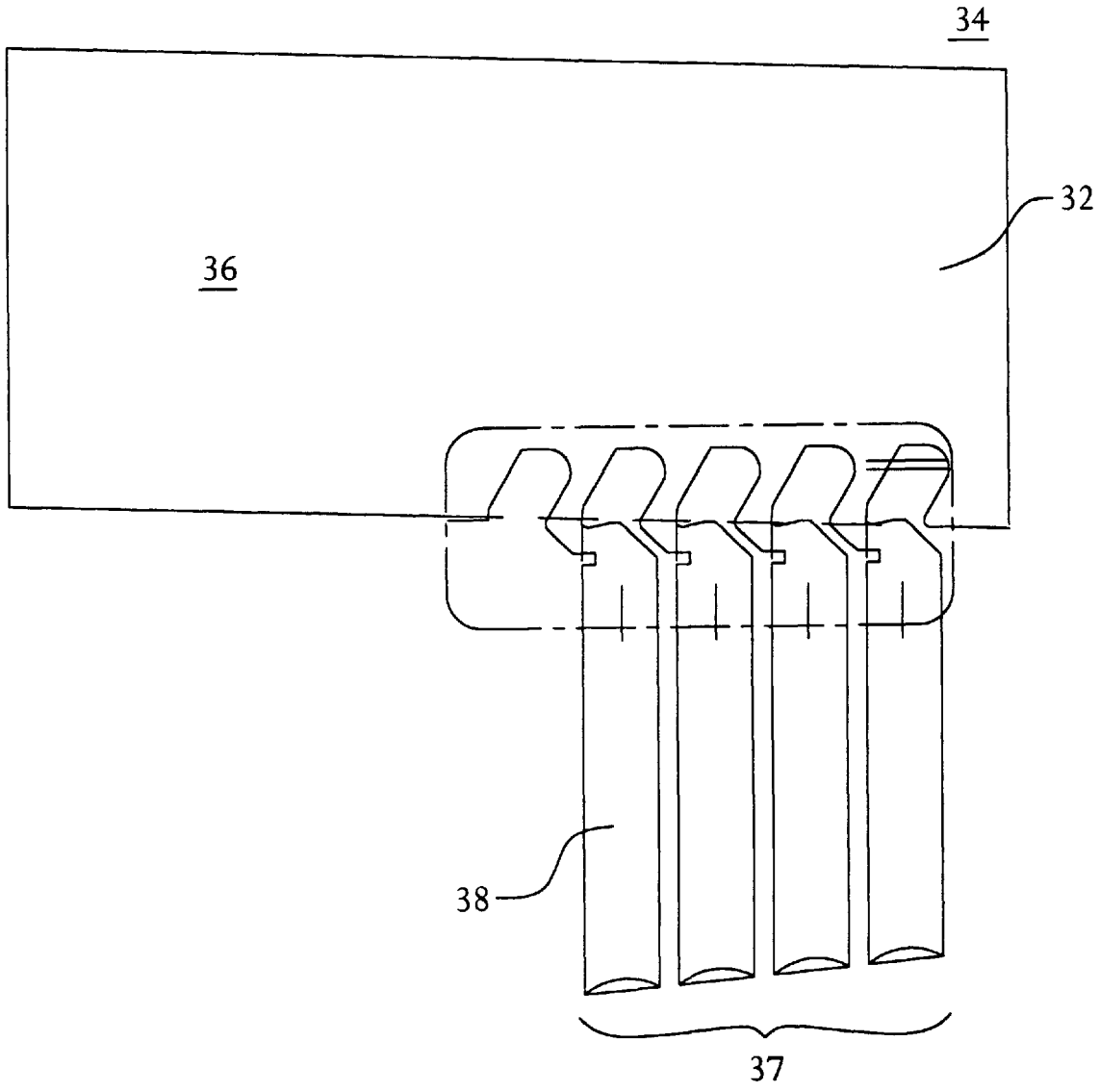
FIG. 2 is a top planar view of a pattern formed in a flat piece of sheet metal.

As shown in FIG. 1A, the process starts with a flat piece of sheet material 32 that is formed into a pattern 34 (Step 100). Preferably, the sheet material is metal. The pattern 34 is formed by cutting, stamping, or the like, into the shape as shown in FIG. 2. At this stage, leg portion 37 lies in the same plane as planar portion 36.

Pattern 34 is then pressed at 110 to form desired three-dimensional characteristics the function of which will become readily apparent from the description herein. FIG. 3A shows that, as a result of steps 100 and 110, the pressed sheet material pattern now comprises planar portion 36, a raised offset portion 40 (shown more clearly in FIG. 6), a leg portion 37 consisting of a plurality of legs 38, and an extended portion shown as lobe 42.

As indicated in FIG. 1A, legs 38 of conductor shield are bent at 120 first along axis y-y so that legs 38 are perpendicular to planar portion 36. Referring now to FIGS. 3*a–c*, two substantially 45 degree bends, B1 (FIG. 3A) and B2 (FIG. 3B), are then made in legs 38. In FIG. 3C, legs 38 are finally bent over axis x-x and into contact with the planar portion 36 thus creating a plurality of equidistant channels 44 whose bottom portion is defined by planar portion 36 and whose walls comprise legs 38. The resulting angles of bends B1 and B2 are selected to create the desired equidistant channels. As a result of bends B1 and B2, channels 44 also define tail receiving portion 46 and a receptacle receiving portion 48.

Legs 38 are secured to planar portion 36 in order to more positively ensure that legs 38 are parallel to each other over their entire length, from tail receiving portion 46 to the receptacle receiving portion 48 thereby maintaining conformity in annular space within each channel. Such parallelism and conformity may be further assured in a particularly effective manner shown in FIG. 3B. As shown in FIG. 3B, planar portion 36 includes apertures 50, while legs 38 have protrusions 52 formed thereon. Apertures 50 and protrusions 52 are selectively located so that protrusions 52 will matingly cooperate with apertures 50 when legs 38 are bent around axis x-x onto planar portion 36. Preferably, protrusions 52 are adapted to be press-fit into apertures 50.

Lobe 42 can be used as a gripping or grasping section to hold a fully constructed connector column 20 (FIG. 5A) during the assembly process for either fitting column 20 into an appropriately formed front housing 12 or for press-fit mass insertion into a PCB. The use of the grasping section allows for easy manipulation of column 20 and permits the column to withstand relatively high assembly forces.

Lobe 42 may also have attached side springs 16 (shown in FIG. 1). If formed of electrically conductive material, side springs 16 operate to establish an electrical contact with an adjacent lobe thereby forming a continuous path across the plurality of lobes. This path, when utilized in conjunction with an optional press fit ground pin connector 18 (also shown in FIG. 1) at the base of lobe 16, forms a ground through connector 10 to the PCB.

Referring to FIGS. 4A–4E, terminals 26 are depicted. Terminals 26 are preferably formed in any manner from conductive material, such as metal, at step 210 in the manufacturing process in FIG. 1A. FIG. 4B depicts preferred terminals 26 as stamped from sheet metal having a thickness "e" about 0.15 mm such that, when laying on a flat surface, the distance "f" from the flat surface to an upper most surface of the stamped terminal 26 is about 0.47 mm. The bend represented by distance f is incorporated into the terminal structure 26 specifically to center the receptacle 30 with respect to the other terminal components 56, 58, and 28 to maximize the equidistant relationship of the terminal from the walls of conductor shield 24, once terminals 26 are integrated into conductor shield 24.

Other conductive material may be used to form terminals 26 such as metalized plastic. The number of stamped terminals 26 will preferably correspond to the number of rows in the final connector product.

As shown in FIGS. 4C and 4E, terminals 26 include a U-shaped receptacle 30 for receiving a plug pin, a straight portion 56, a tail portion 58, and a press-fit portion 28 for PCB insertion. The initial receptacle pitch "c" (FIG. 4A) of the stamped terminals 26 will be limited by the manufacturing process, for example, to approximately 2.54 mm. The initial pitch "g" (FIG. 4A) of press-fit tail portion 28 is less limited by the manufacturing process and will be about 2.0 mm. To reduce the initial receptacle pitch "c" to a desired pitch, bends 60 are made in the portion of the stamped terminals 26 between press-fit portions 28 and the carrier frame 62 at manufacturing step 230 (FIG. 1A). Bends 60 are formed after portions of carrier frame 36 adjacent to receptacle portions 30 have been removed at step 220.

For example, to reduce the receptacle pitch from about 2.54 mm to a new receptacle pitch "d" of about 2.0 mm, a series of stamps (bends 60) need to be made at different degrees as shown in FIG. 4D such that "h" is about 0.6 mm, "i" is about 0.87 mm, "j" is about 1.14 mm, "k" is about 1.41 mm, and "g," which represents "f" from FIG. 4B, is adjusted to about 0.32 mm.

Referring to FIGS. 5A–B and 6, stamped terminals 26 are laid within the conductor shield 24 at equal annular distances from conductor shield 24 at step 130 (FIG. 1A). At least part of the space between terminals 26 and the channels comprised of planar portion 36 and legs 38 is filled with an insulator. Preferably, an insert molding process is used to integrate terminals 26 and conductor shield 24 into one article. More preferably, molding material 64 is filled only in tail portion 46. In such an embodiment, the bodies of insulative plastic material are inserted in the channels in surrounding relationship to the tail portions of the terminals. This integrated unit defines the shielded connector column 20.

Once terminals 26 are integrated with conductor shield 24, the remainder of carrier frame 62 is removed from press-fit portion 28 of terminals 26. It is noted that removal of carrier frame 62 also involves removal of bends 60 previously formed therein.

Referring to FIGS. 7–8, shielded connector column structure 20 is inserted into an appropriately formed front housing 12 to form connector 10 with the desired number of receptacle positions 14 at step 140 (FIG. 1A). Preferably, the front part of the shielded connector column 20 is inserted into a short recess slot 66 at the rear of the front housing 12. As can be seen in FIG. 7, a number of slots are formed in front housing 12 thereby forming a number of fingers 70. Each finger 70 is sized to fit around receptacle portion 30 and within channel 44. After insertion, a plurality of shielded connector column modules are positioned adjacent to each other and terminals 26 are shielded from electronic interferences for the entire length of contact area 48 through tail portion 46. The terminals 26 will also be shielded from electronic interferences between all adjacent terminals—both vertically (between columns) and horizontally (between rows).

Front housing 12 can be made by molding plastic or plastic that is selectively metalized to establish and maintain a ground connection between a plug 68 and receptacle 30 (step 300).

While the present invention has been described in connection with the various figures, it is to be understood that other embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector, comprising:

a plurality of column connector modules, wherein each column connector module comprises a shield having a lobe portion and having channels, wherein each of said channels includes a receptacle receiving portion and a tail receiving portion, and a plurality of conductive terminals, wherein each conductive terminal is positioned within a channel of the shield wherein the conductive terminals are spaced at substantially equal annular distances from the shield, wherein the conductive terminals each comprise a tail portion and a receptacle portion; and a housing having a plurality of openings defining a receptacle grid on a front portion thereof and a plurality of recess slots in a rear portion wherein the plurality of recess slots matingly receive the plurality of column connector modules such that the tail receiving portion of the channels and the lobe portion of the shield remains outside of the housing and wherein the plurality of column connector modules are adjacent to each other thereby shielding the terminals throughout the entire length of the channels.

2. The connector of claim 1, wherein said shield is formed from a single piece of a material.

3. The connector of claim 1, further comprising insulative insert material, wherein said conductive terminals are fixed to said shield by said material.

4. The connector of claim 3, wherein said material is only present in the tail receiving portion of said channels.

5. The connector of claim 4, wherein the recess slots in the housing define a plurality of fingers, wherein each finger is inserted into the receptacle receiving portion of the channel.

6. The electrical connector of claim 1, further comprising a side spring attached to each lobe portion, wherein the side spring is in contact with the lobe portion of an adjacent module.

7. The electrical connector of claim 1, further comprising a press-fit pin attached to one end of the lobe portion of the connector shield.

* * * * *